US005450684A

United States Patent [19]

Harris

[11] Patent Number: 5,450,684

[45] Date of Patent: Sep. 19, 1995

[54] TRIGGER SHIELD

[76] Inventor: Jon H. Harris, 6073 Airmont Dr., Spring Hill, Fla. 34606

[21] Appl. No.: 289,962

[22] Filed: Aug. 12, 1994

[51] Int. Cl.[6] ..... F41A 17/54
[52] U.S. Cl. ..... 42/70.07
[58] Field of Search ..... 42/70.07

[56] References Cited

U.S. PATENT DOCUMENTS

| | | | |
|---|---|---|---|
| 2,598,924 | 6/1952 | Lind | 42/70.07 |
| 3,184,875 | 5/1965 | Klebe | 42/70.07 |
| 3,711,979 | 1/1973 | Small | 42/70.07 |
| 4,499,681 | 2/1985 | Bako et al. | 42/70.07 |

*Primary Examiner*—Charles T. Jordan
*Assistant Examiner*—Theresa M. Wesson
*Attorney, Agent, or Firm*—Joseph C. Mason, Jr.; Ronald E. Smith

[57] ABSTRACT

A trigger shield sandwiches the trigger guard and trigger of a weapon between a base plate and a cover plate to prevent accidental discharge of the weapon. In a first embodiment, a plurality of posts tipped by resilient barbs interconnect the base and cover plates in sandwiching relation to the trigger guard and the plates cannot be separated until the barbs are compressed. A release plate for compressing the barbs is placed into overlying relation to the cover plate and the release and cover plates are then removed as a unit to remove the trigger shield from the weapon. In a second embodiment, the cover plates of a weapon handle are pivotally mounted to the handle so that they can pivot into shielding relation to the trigger guard. In a third embodiment, a single post has a first straight part that extends through apertures formed in the base and cover plates and includes a second part that flares out and locks in a cam over center configuration to prevent facile retraction. A fourth embodiment employs a construction remniscent of a nail clipper, a fifth provides multiple posts on the base plate to make it more versatile, and the sixth embodiment includes extension plates that change the effective size of the base and cover plates so that trigger guards of differing sizes may be shielded.

4 Claims, 7 Drawing Sheets

TRIGGER SHIELD

BACKGROUND OF THE INVENTION

1. Field of the Invention

This invention relates, generally, to safety devices for weapons such as pistols. More particularly, it relates to devices that prevent a child from pulling the trigger of a weapon.

2. Description of the prior art

Weapons usually include a safety device intended to prevent accidental discharge, but accidental discharges of weapons still take many lives per year. Many fatalities occur because a weapon owner often forgets to set the safety, and many more occur because the safety is so easily removed from its operable position. Thus, a child playing with a weapon may first accidentally disable the safety, rendering the weapon ready to fire, and may then accidentally discharge the weapon.

Thus, there is a need for a life-saving device that prevents a toddler or a child (as well as an adult) from accidentally discharging a weapon. The device should be removable by an adult who knows how to remove it, but should be virtually impossible for a child to remove.

However, in view of the art at the time the present invention was made, it was not obvious to those of ordinary skill how such a device could be provided.

SUMMARY OF THE INVENTION

The longstanding but heretofore unfulfilled need for a safety device that is easy to install but difficult to remove if its method of removal is unknown has now been fulfilled.

In a first embodiment of the invention, a plurality of upstanding posts are mounted on a base plate, and one or more resilient barbs are formed along the extent of said posts. The trigger guard of a weapon is placed into overlying relation to the base plate in such a way as to position some of the posts inside the area circumscribed by the trigger guard and some of the posts outside said area. A cap plate having a plurality of openings formed therethrough is then aligned with the base plate so that the posts align with the openings and the cap plate is engaged to the base plate by inserting the posts through the openings until the barbs pass through the openings and prevent facile separation of the base and cap plates so that the trigger is shielded by said plates.

The barbs may be pinched individually to enable separation of the base and cap plates, and separation of such plates through such expediency is within the scope of this invention. However, the preferred means for separating the plates includes a release plate having a plurality of cylindrical members depending therefrom. The release plate is aligned with the cap plate until the cylindrical members are in alignment with the barbs protruding through the openings in the cap plate. The release plate is then placed into overlying relation to the cap plate so that each cylinder receives its associated barbs. The diameter of each cylinder is less than the diameter of each barb so that each barb is compressed by its respective cylinder. When each barb is so compressed, the release and cap plates are removed as a unit and the trigger is again accessible.

In a second embodiment, modified handle cover plates are used as the trigger guard plates. The handle cover plates are first slid downwardly into a first, lowered position and then rotated counterclockwise into a second position where they sandwich the trigger and trigger guard assembly. The cover plates may be slid toward the handle and a lock means is employed to lock said cover plates into position. The procedure is reversed to uncover the trigger and trigger guard and to restore the handle cover plates to their usual position.

In a third embodiment, a single large locking member in the form of a hollow wall anchor interlocks the base and cap plates in sandwiching relation to the trigger guard. It has its own release means and no release plate is required.

A fourth embodiment employs a pivotally mounted latch member that interlocks the base plate and the cover plate.

A fifth embodiment is similar to the first but the base plate includes a large plurality of openings so that the device may be employed with fire arms of many differing sizes and configurations.

In a sixth embodiment, both the base plate and the cover plate have extension members so that they can be adapted to fit differing weapons of differing sizes and shapes.

It is thus understood that a primary object of the invention is to provide trigger shields that are easy to install yet not easy for a child to remove.

A more specific object is to provide trigger shields that may be easily installed and easily and quickly removed by an adult who knows how to perform the removal procedure.

Another important object is to provide trigger shields that accommodate a large plurality of weapons of many different sizes and shapes.

These and other important objects, features and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
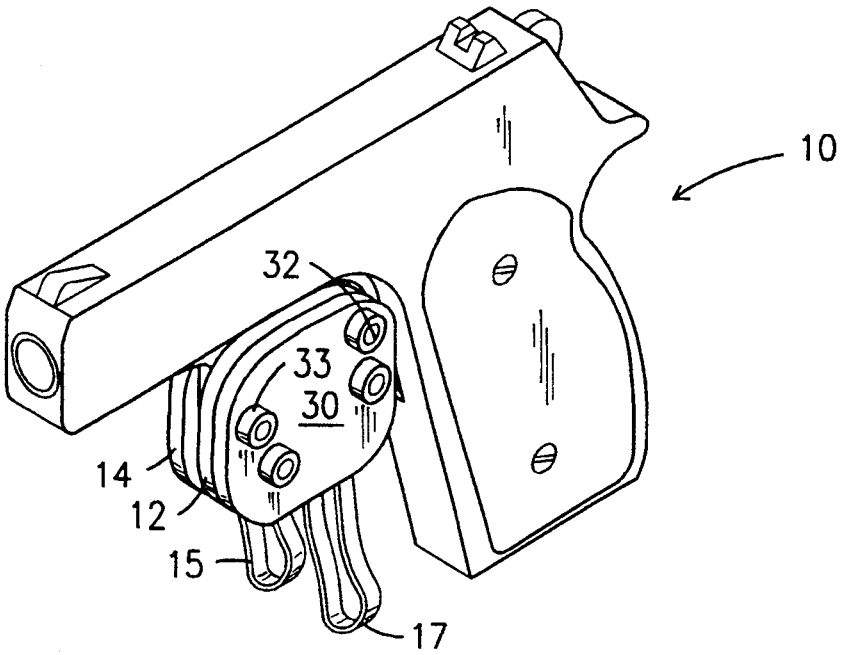
FIG. 1 is a perspective view of a first embodiment of the invention installed on a pistol.

Referring now to FIG. 1, it will there be seen that a first illustrative embodiment of the invention is denoted as a whole by the reference numeral 10.

Trigger shield 10 includes flat base plate 12 and flat cover plate 14. Four posts, collectively denoted 16, are fixedly mounted to base plate 12 in upstanding relation thereto in a predetermined array.

As best understood in connection with FIGS. 3–7, a plurality of barbs, collectively denoted 18, are formed in each post along its extent. In another embodiment, not specifically disclosed, a single barb surmounts each post; FIGS. 3–7 should also be construed as depicting said single-barbed posts.

Cover plate 14 has four throughbores 20 formed therein, each of which is in registration with a post 16. The diameter of each throughbore is sufficient to cause resilient barbs 18 to compress upon passage therethrough, and to prevent retraction of such barbs after their resiliency has returned them to their deployed position of repose after extending through said throughbores.

Figure 4:
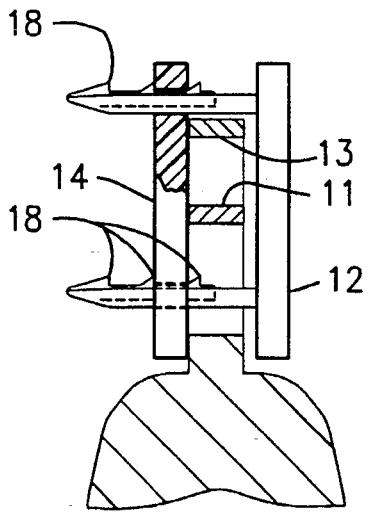
FIG. 4 is the second view in said animation.
Figure 5:
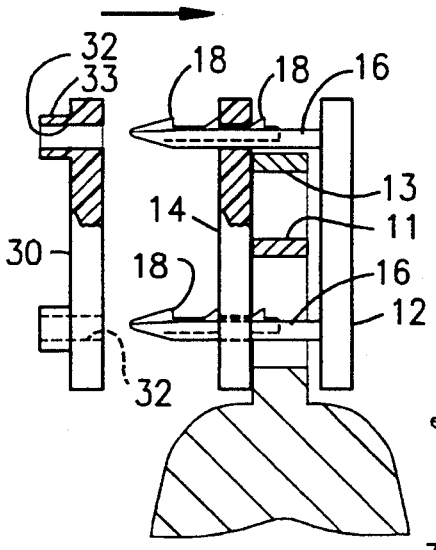
FIG. 5 is the third view in said animation.

To use this structure, a trigger 11 and trigger guard assembly 13 are placed into overlying relation to base plate 12; half of the posts are disposed on one side of trigger guard 13 and half are disposed on the other side of said guard. Thus, guard 13 is retained between said posts, and, after barbs 18 have extended through apertures 20 and returned to their deployed configuration, facile separation of the base and cap plates cannot be accomplished by a child. An adult, however, may individually pinch each barb 18 to compress it and enable it to retract through its associated throughbore so that the base and cap plates may be separated from one another and the weapon rendered operable. In other words, when the base and cover plate are disposed in sandwiching relation to trigger guard 13 as depicted in FIG. 4, pinching of barbs 18 enables an adult to remove cover plate 14, i.e., to return the assembly to its FIG. 3 position.

Figure 6:
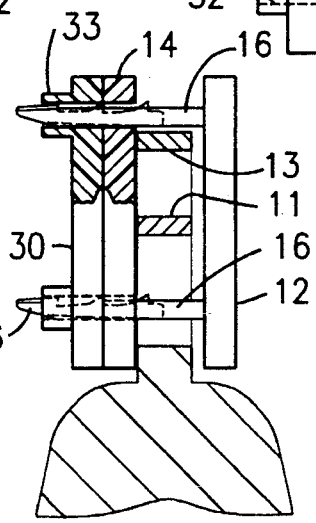
FIG. 6 is the fourth view in said animation.
Figure 7:
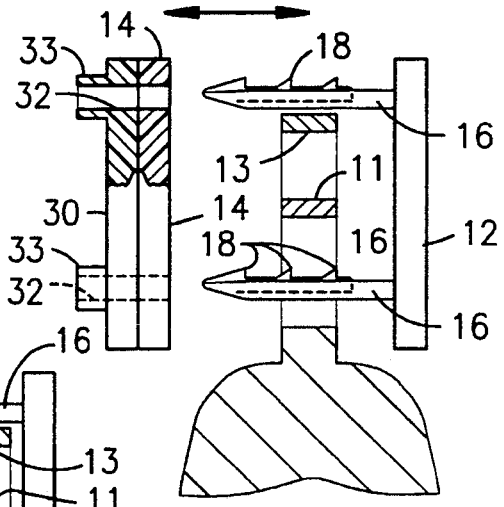
FIG. 7 is the fifth view in said animation.

In a variation of this first embodiment, a release plate 30, shown in FIGS. 1, 2, and 5–7, is provided to facilitate the barb compression process. Release plate 30 has four throughbores 32 Formed therein, and each throughbore has an inner diameter equal to or less than the diameter of its associated barb 16. As best understood in connection with FIGS. 5–7, release plate 30 is used by placing it into overlying relation to cap plate 14, aligned so that each throughbore 32 receives a barb 18 therewithin. When each barb 18 is received within a throughbore 32, as depicted in FIG. 6, both the cover plate 14 and the release plate 30 are separated as a unit from base plate 12, as depicted in FIG. 7, thereby removing the trigger shield and rendering the weapon operable. A boss 33 (FIGS. 5–7) may be provided on the trailing side of each throughbore 32 to effectively thicken release plate 30. If the bosses 33 are not provided, and if release plate 30 is too thin, said release plate may be captured by a barb 18.

Release plate 30 may be stored by releasably engaging it to the trailing side of base plate 12. Posts 34 (FIG. 2) are tightly but releasably received within throughbores 32 of release plate 30 when said release plate is releasably secured to base plate 12 as depicted in FIG. 1.

Figure 2:
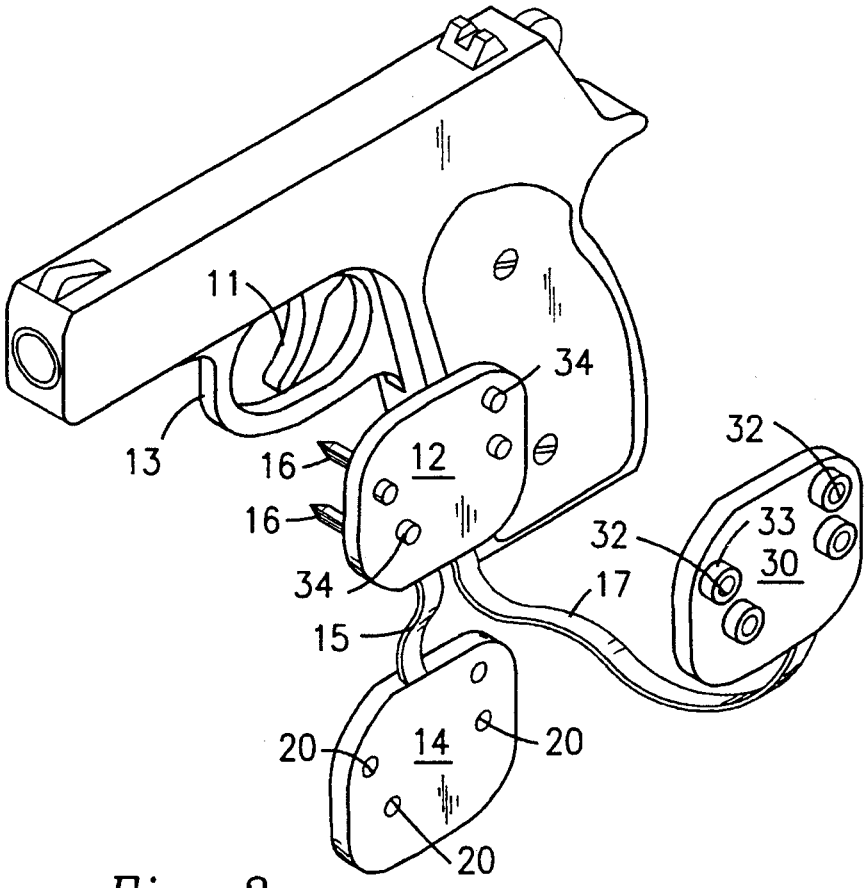
FIG. 2 is a perspective view of said first embodiment in an exploded configuration so that its three main parts are better depicted.
Figure 3:
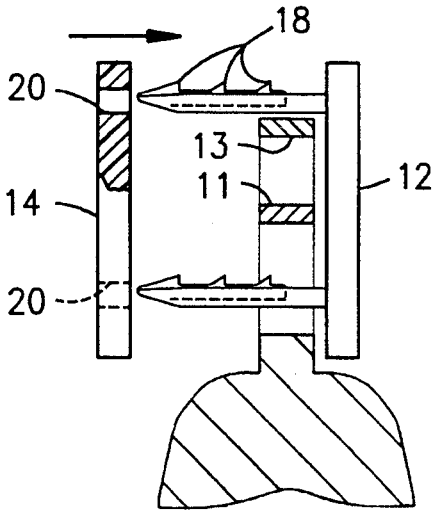
FIG. 3 is the first view in an animation depicting the procedure for installing and removing the embodiment of FIGS. 1 and 2, all views of said animation being side elevational, partially sectional views.

To avoid losing parts 12, 14, and 30, they may be interconnected to one another by elongate, flexible strap means as depicted in FIGS. 1 and 2. Strap 15 may be employed to interconnect the base and cover plate, and strap 17 may be employed to interconnect the base and release plate.

In a second embodiment, depicted in FIGS. 8–11, handle covers 40, 40 are employed as handle covers when the weapon is in its operable configuration, and are employed as trigger shields when it is desired to render the weapon safe from accidental discharge.

Figure 8:
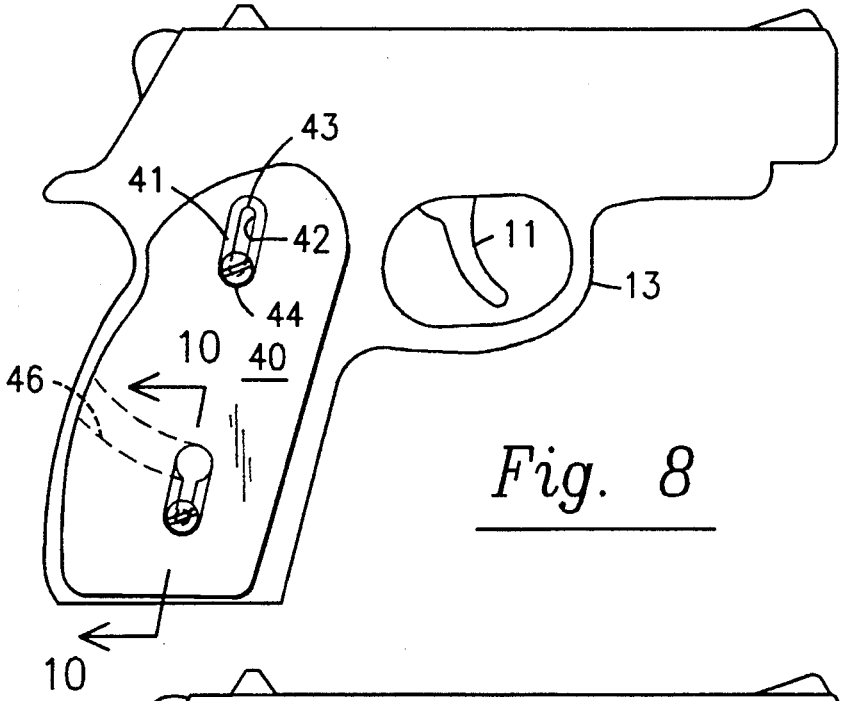
FIG. 8 is a side elevational view depicting a second embodiment of the invention.
Figure 9:
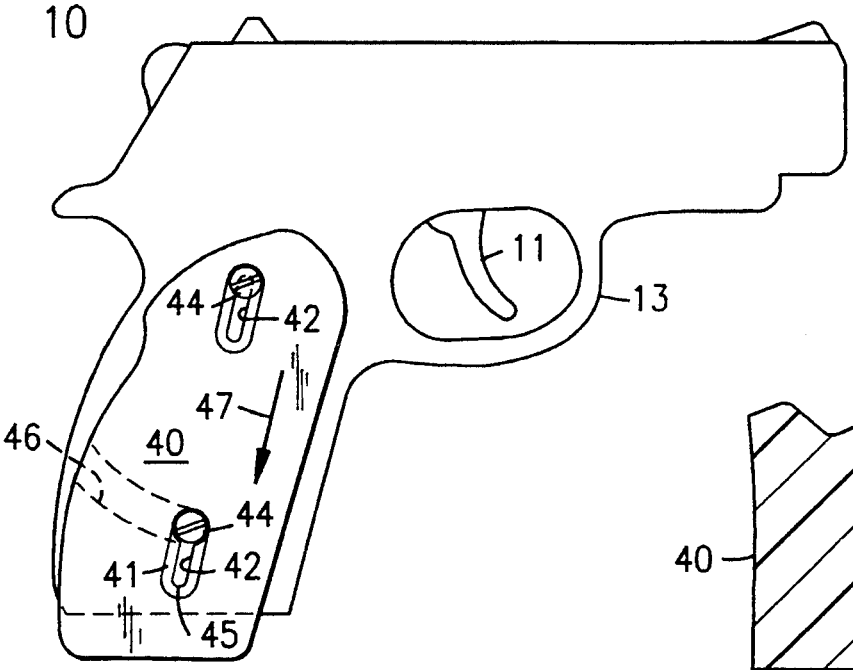
FIG. 9 is a view similar to that of FIG. 8, but showing the handle of the weapon in a displaced configuration.
Figure 10:
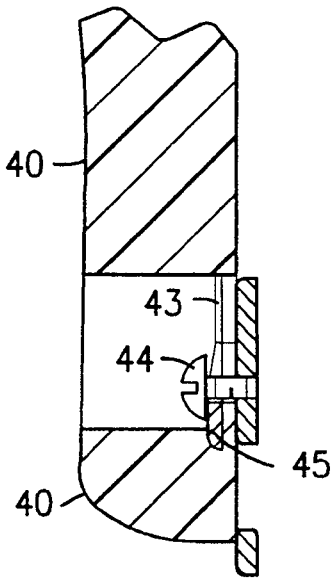
FIG. 10 is a sectional view taken along line 10—10 in FIG. 8.

A pair of elongate slots 42, 42 are formed in said handle covers, and each slot is generally vertically oriented, i.e., aligned with the longitudinal axis of the weapon's handle. The peripheral edges 41 of each slot are tapered in thickness so that the uppermost end 43 of each slot is thinner than the lowermost end 45, as perhaps best understood in connection with FIG. 10. A screw having a head 44 is disposed in each slot and the thick end of the slot edges are captured beneath the head of the screw as depicted in FIG. 10 when the assembly is in its FIG. 8 configuration. In other words, when the handle covers 40, 40 are in their normal configuration as depicted in FIG. 8, the slot edges are tightly wedged beneath the screw head and as a result the handle covers are held into position just as they would be if conventionally screwed into position. However, upon sliding the handle covers in the direction indicated by directional arrow 47 in FIG. 9, the handle covers are displaced into the lowered position depicted in said FIG. 9; note that covers 40, 40 are now loosely held by screws 44 due to the thinness of the slot edges at their respective lowermost ends 43.

Figure 11:
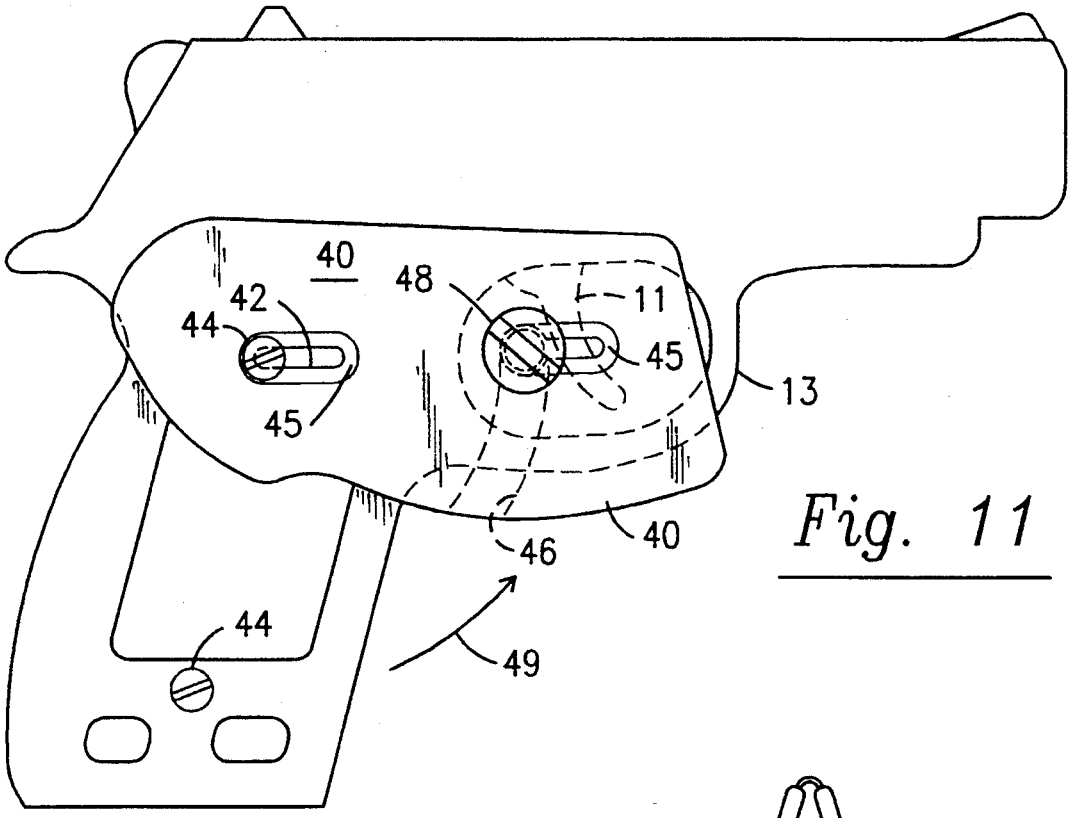
FIG. 11 is a view similar to that of FIG. 8, but showing the handle of the weapon rotated into a trigger shielding position.

Accordingly, handles 40 may now be swung counterclockwise as indicated by directional arrow 49 in FIG. 11. Arcuate slot 46, formed in the underside of cover 40, allows screw 44 to remain in position when cover 40 is so rotated. Access to trigger 11 and trigger guard 13 is blocked when the covers have been rotated. A bolt 48 or other suitable fastener is then inserted through the trailing end of slot 42 to interlock handles 40, 40 to one another as depicted in FIG. 11. If desired, handles 40 could be slid rearwardly (i.e., to the left in FIG. 11) to tighten them before fastener 48 is employed, but there is no need to do so.

Figure 12:
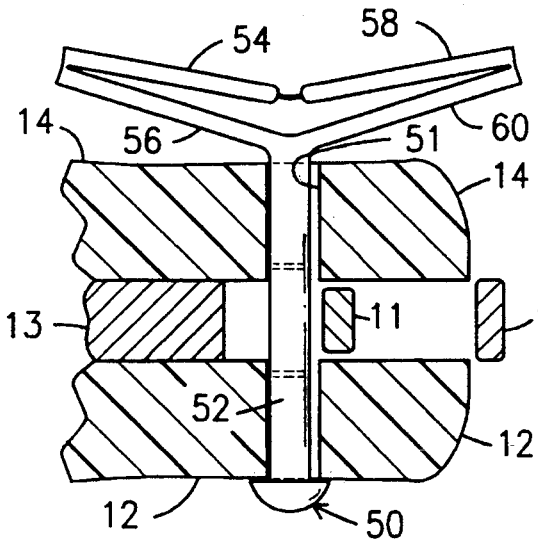
FIG. 12 is a partially sectional view of a third embodiment of the invention showing a hollow wall anchor used as a means for holding together the base and cover plates.
Figure 13:
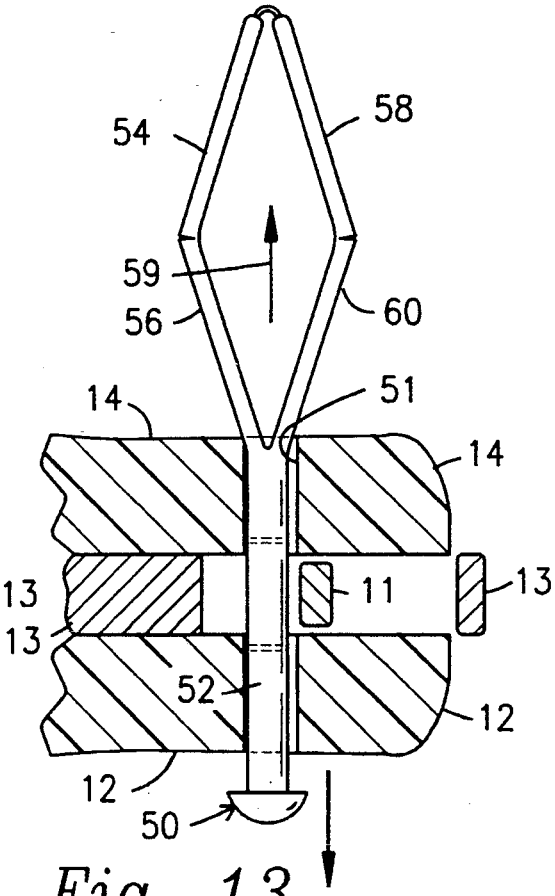
FIG. 13 is a view like that of FIG. 12, but showing the hollow wall anchor in its collapsed configuration so that the base and cover plates may be separated.
Figure 14:
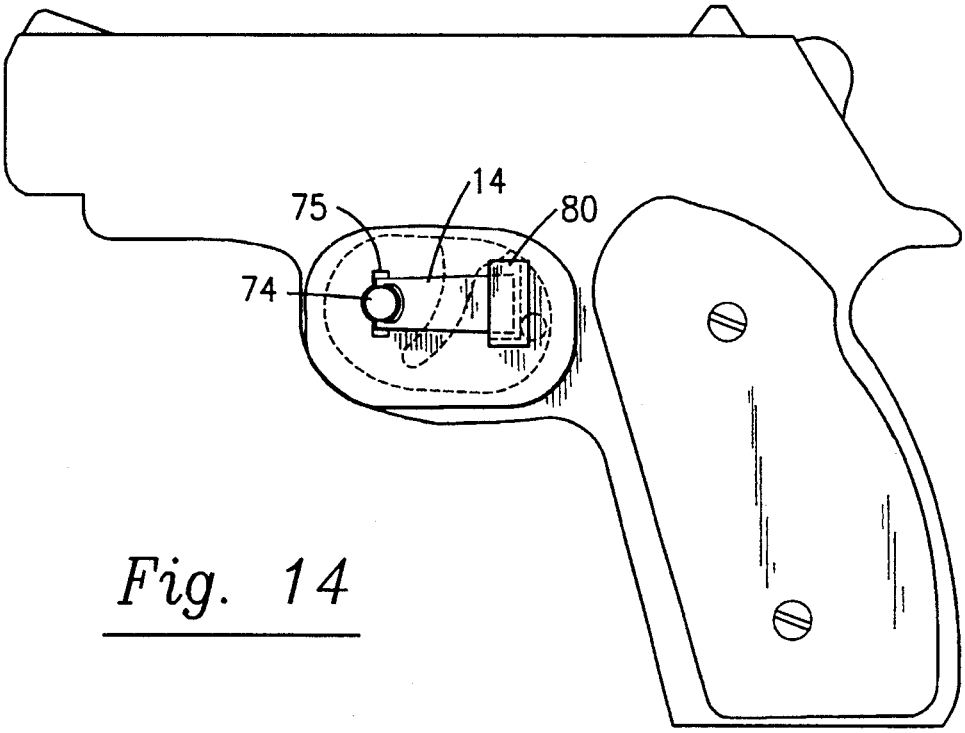
FIG. 14 is a side elevational view of a fourth embodiment installed on a pistol.

In a third embodiment, disclosed in FIGS. 12 and 13, base plate 12 and cover plate 14 are imperforate but for a central aperture 51 formed therein. A single post in the form of a hollow wall anchor 50 is mounted to base plate 12 in upstanding relation thereto, and said central aperture 51 receives said post therethrough. Post 50 has a shank 52 having a length equal to or slightly greater than the combined thicknesses of base plate 12, cover plate 14, and the thickness of trigger guard 13. It further includes a second part formed by four legs 54, 56, 58 and 60 which are hingedly interconnected to one another and which collectively form a parallelogram. As depicted in FIG. 12, when legs 56 and 60 are fully spaced apart from one another, legs 54 and 58 pass through a cam over center and are held in the FIG. 12 configuration, thereby preventing a child from inadvertently removing the post. An adult, however, can overcome the cam over center by pulling on legs 54, 58 in the direction indicated by directional arrow 59 in FIG. 13 to enable retraction of post 50 through throughbore 51.

Figure 15:
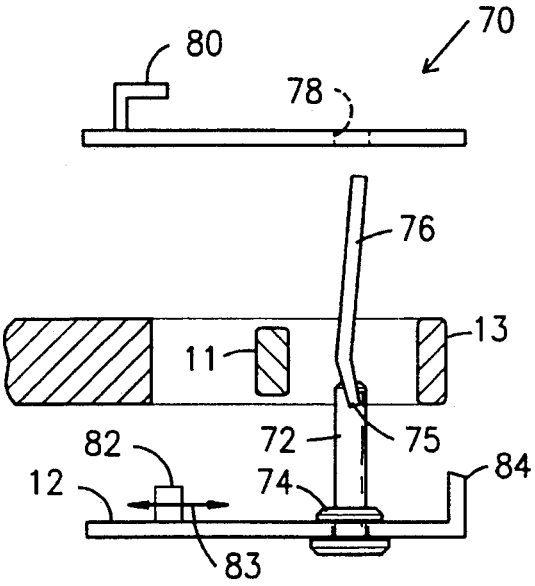
FIG. 15 is a side elevational, partially sectional, exploded view of the fourth embodiment.
Figure 16:
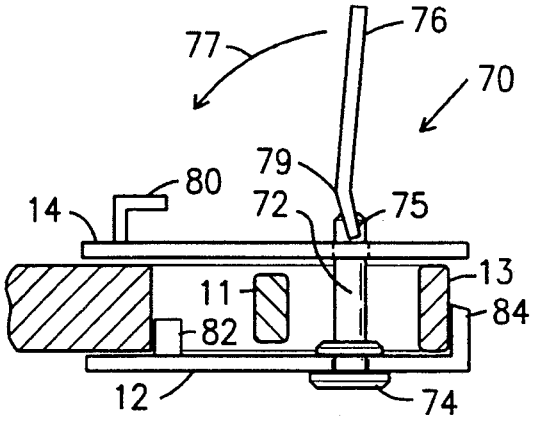
FIG. 16 is a view similar to FIG. 15, but showing the parts in their assembled configuration with the pivotally mounted latch in its open configuration.
Figure 17:
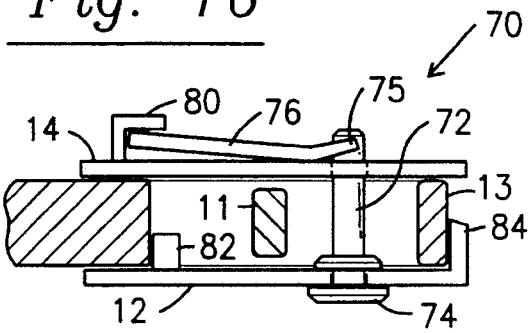
FIG. 17 is a view like that of FIG. 16, but showing the latch in its closed configuration.

A fourth embodiment 70 is depicted in FIGS. 14–17. An upstanding post 72 is riveted as at 74 to base plate 12 and a handle 76 is pivotally mounted to said post as at 75. Post 72 is swivelly mounted so that handle 76 can rotate. As in the other embodiments, base plate 12 and cover plate 14 are first positioned on opposite sides of a trigger guard 13 as depicted in FIG. 15. Handle 76 and post 72 are then inserted through throughbore 78 formed in cover plate 14 as depicted in FIG. 16. To lock the trigger shield into position, handle 76 is pivoted in the direction denoted by directional arrow 77 and is simultaneously rotated into or out of the plane of the paper so that the distal free end thereof may extend past engagement latch 80. After said distal free end of handle 76 has extended past said latch 80, said handle is again rotated out of or into the plane of the paper until it it disposed in captured relation relative to latch 80. Note bend 79 formed in handle 76 near its proximal end; as depicted in FIG. 17, said bend 79 presses down on cover plate 14 and holds it in tightly sandwiched relation with base plate 12 and trigger guard 13. Note post 82 and projection formed in base plate 12; collectively, they align the base plate with the trigger guard 13. Post 82 is slideably mounted in a slot formed in base plate 12 so that it is movable as indicated by double-headed directional arrow 83. This enables trigger shield 70 to fit weapons of many differing sizes.

Figure 21:
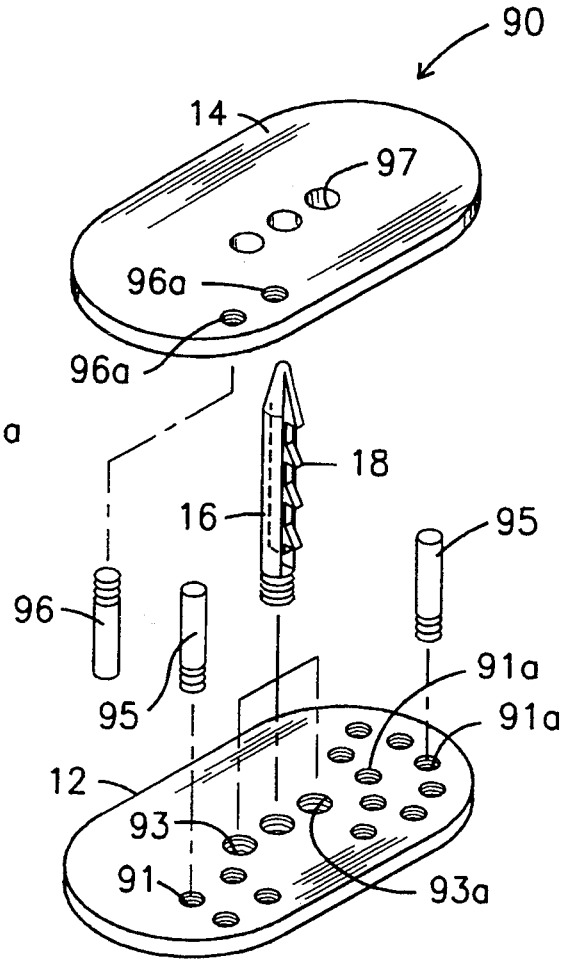
FIG. 21 is an exploded perspective view of the parts of the fifth embodiment.
Figure 22:
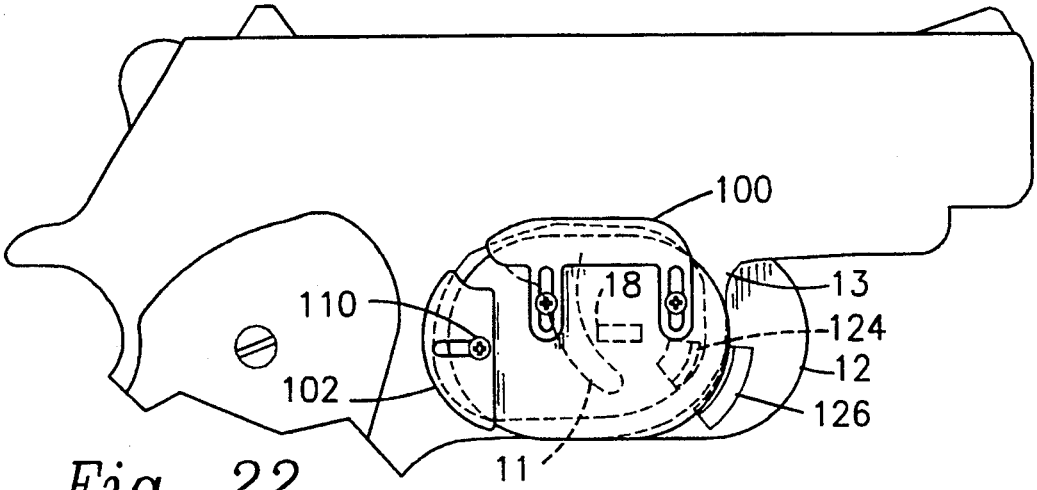
FIG. 22 is a side elevational view of a pistol equipped with the sixth embodiment of this invention.
Figure 23:
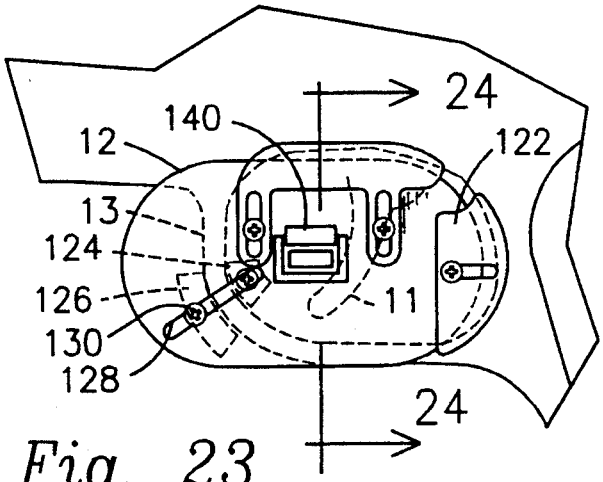
FIG. 23 is a view like that of FIG. 22, but depicting an extension member in an extended position.

An embodiment that fits firearms having many differing trigger guard and trigger configurations is depicted in FIGS. 18–21 and is denoted as a whole by the reference numeral 90. Base plate 12 has numerous small throughbores, collectively denoted 91, formed therein, and a smaller plurality of larger throughbores, collectively denoted 93; all of the throughbores are internally threaded as shown in FIG. 21. The smaller throughbores 91 receive stop posts 95 as indicated in FIG. 21, and an interlocking post 16 having one or more barbs 18 is received within a preselected larger throughbore 93.

Cover plate 14 is provided with a smaller number of small throughbores **96*a* and the same number of larger throughbores 97 as base plate 12 has large throughbores 93**.

Figure 18:
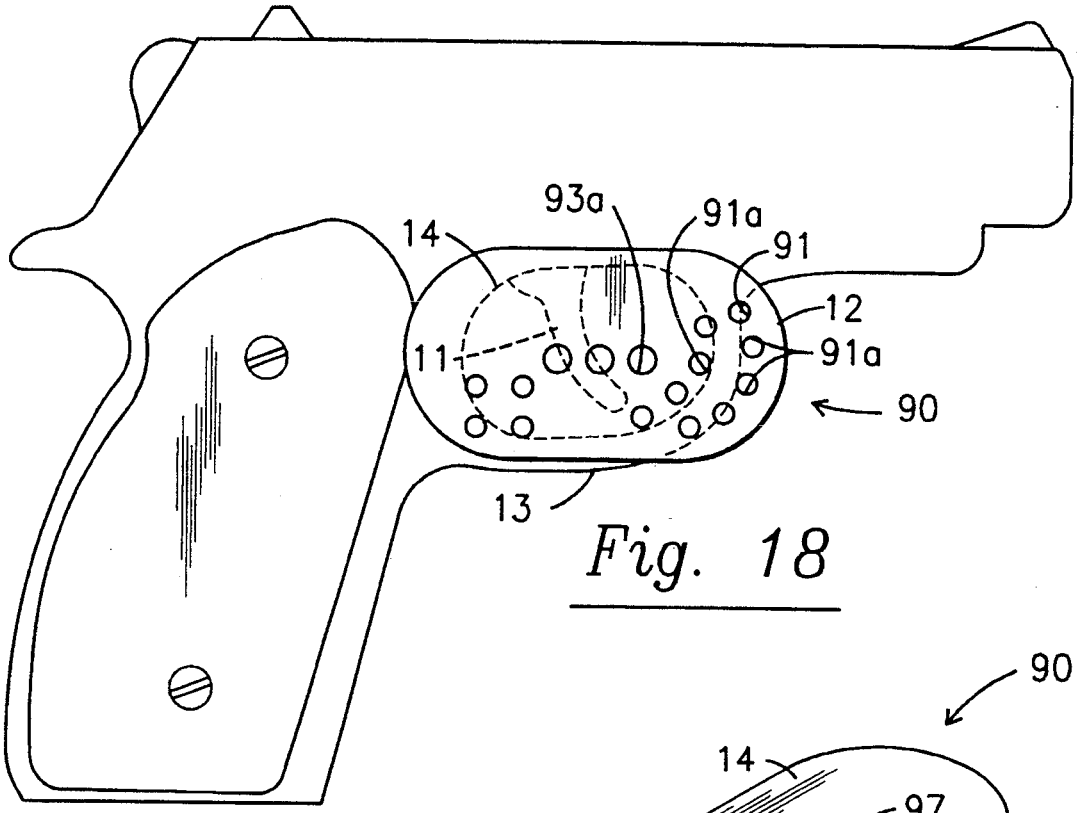
FIG. 18 is a side elevational view of a pistol equipped with a fifth embodiment of the invention.
Figure 19:
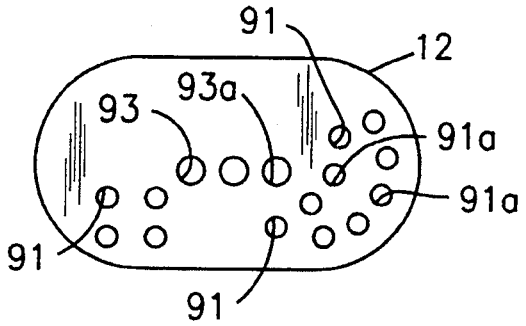
FIG. 19 is a top plan view of the base plate of the fifth embodiment.
Figure 20:
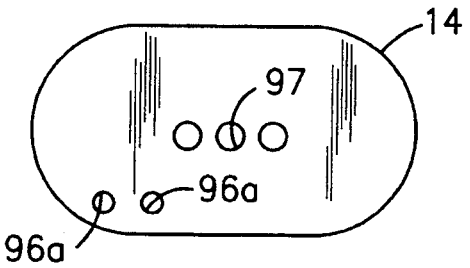
FIG. 20 is a top plan view of the cover plate of the fifth embodiment.

When said base plate and cover plate are positioned in sandwiching relation relative to trigger guard 13 as depicted in FIG. 18, many of the smaller throughbores 91 in base plate 12 may not receive stop posts 95 because they are blocked by trigger guard 13 as may be understood upon inspection of FIG. 18. Only those small throughbores denoted **91*a* may receive said stop posts because they are not blocked by said trigger guard. Note that the small throughbores denoted 91*a*, 91*a* are on opposite side of trigger guard 13, so that stop posts 95 received therewithin capture said trigger guard therebetween and prevent relative movement between said plates 12 and 14 and said trigger guard. Note also that small throughbore 96*a* of cover plate 14 is in alignment with a small throughbore 91 of base plate 12** near the trailing edge of the trigger guard.

Similarly, as depicted in FIG. 18 in this illustrative example, two of the larger throughbores 93 in base plate 12 are prevented from receiving a post 16 because such is blocked by trigger 11, i.e., only the large throughbore denoted **93*a* may receive a post therethrough for interlocking with cover plate 14 through a large throughbore 97. Since there are three large throughbores 93 in base plate 12 and the same number of large throughbores 97 in cover plate 14, there are nine different relative positions that said confronting plates may take, thereby enabling a post 16** to be fitted into interlocking relation between said plates regardless of a wide range of trigger positions in differing fire arms.

Note that trigger guard 13 may also be sandwiched between a large post 16 and a smaller post 95 (base plate 12 ) or 96 (cover plate 14). For example, the trigger guard of a pistol of a different design could be captured in a locking space between a post 16 in throughbore **93*a* (see FIG. 18), and a smaller post 95 in throughbore 91*a***.

The sixth and final illustrative embodiment is depicted in FIGS. 22–27, but it should now be clear that many other embodiments are within the scope of this invention.

The base and cover plates of this embodiment are provided with movable extension plates that enable adaptation of the novel trigger shield to trigger guards of many differing sizes and shapes.

Figure 26:
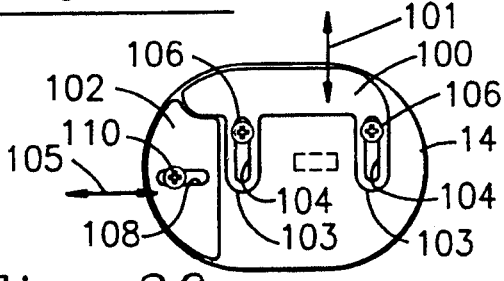
FIG. 26 is a top plan view of the cover plate of the sixth embodiment.

Specifically, as best depicted in FIG. 26, cover plate 14 has a first extension plate 100 and a second extension plate 102. Extension plate 100 has a pair of laterally spaced apart legs 103 that depend from the main body thereof and each leg is slotted as at 104. A screw 106 is positioned in each slot and extends through a screw-receiving throughbore formed in cover plate 14. Thus, each screw 106 may be tightened and loosened, but said screws are not free to slide within said slot. When the screws are loosened, first extension plate 100 may be raised or lowered with respect to cover plate 14 as indicated by double-headed directional arrow 101, thereby changing its effective size in the height dimension. Similarly, as indicated by double-headed directional arrow 105, second extension plate 102 may be laterally displaced by an amount equal to the longitudinal extent of slot 108 formed therein upon loosening of screw 110. In this manner, the effective height and length of cover plate 14 are changeable to accommodate trigger guards of differing sizes and shapes upon displacement of extension members 100 and 102, respectively.

Two similar extension members 120 and 122 are connected to base plate 12 through the same screw and slot arrangement for the same reason.

This embodiment also includes means enabling the attachment of base plate 12 to trigger guards of many differing sizes. A radially extending slot 128 is formed in said base plate to accommodate a first and a second fastening means in the forms of screws, collectively denoted 130. Each screw has a base plate-engaging head disposed on a top surface thereof, and a shank that extends through said slot. The free end of a first screw 130 engages a first stop means 124 and a free end of a second screw 130 engages a second stop means 126. Thus, when the screws are loosened, stop members 124, 126 are slideable along the extent of radial slot 128 so that they may be positioned on opposite sides of trigger guards of differing sizes and configurations. Once properly positioned, the screws are tightened and said stop blocks prevent movement of base plate 12 with respect to said trigger guard. The position of slot 128 is not limited to the particular radial orientation depicted in FIGS. 22, 23, and 27, i.e., any other radial position, including horizontal, is within the scope of this invention.

Figure 24:
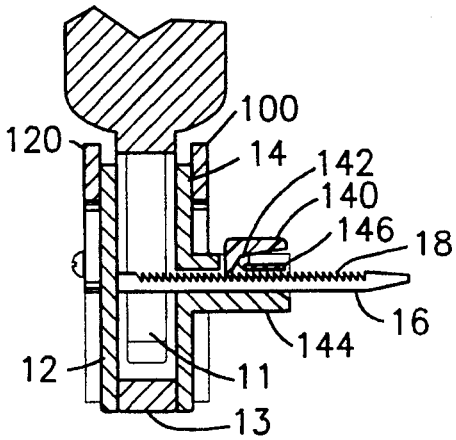
FIG. 24 is a sectional view taken along line 24—24 in FIG. 23.
Figure 25:
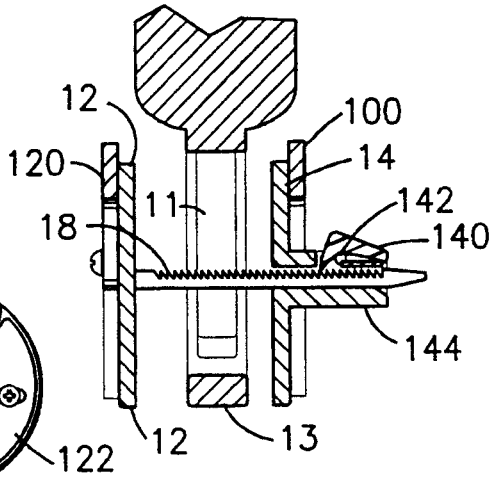
FIG. 25 is a sectional view similar to FIG. 24, but showing said parts in their unlocked configuration.
Figure 27:
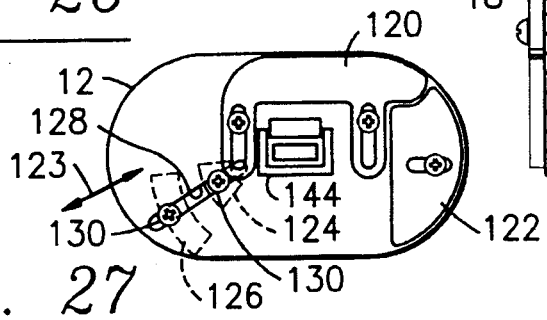
FIG. 27 is a top plan view of the base plate of the sixth embodiment.

Any interlocking means may be employed to hold the base and cover plates in sandwiching relation to trigger guard 13. One suitable interlocking means is depicted in FIGS. 24 and 25. It includes a post 16 with barbs 18 as in some of the earlier embodiments, and further includes a pivotally mounted catch means 140 that is pivotally mounted as at 142 to boss 144 formed in cover plate 14. In this embodiment, a torsion spring 146 maintains catch 140 in its barb-engaging position of repose as depicted in FIG. 24. When so disposed, catch 140 prevents retraction of post 16 and thus maintains the base and cover plates in their sandwiched relation to trigger guard 13. When displaced by a knowledgeable adult into its pivoted position against the bias of spring 146 as depicted in FIG. 25, catch 140 disengages from said barbs and separation of the base and cover members is possible.

It is not necessary that trigger guard 13 be captured between stop means 124 and 126. For example, a trigger guard 13 of different design could be captured between stop member 124 and post 16. It should also be observed that the curvature of stop members 124, 126 also limits movement of the assembly, so capture of the trigger guard 13 therebetween is not always required.

In yet another embodiment, not depicted, torsion spring 146 is not needed. Catch member 140 is simply replaced by a self-biased member. A suitable device having a self-biased catch member is disclosed in U.S. Pat. No. 4,236,280, is commercially available from Richco, and is called a "release tab wrap-it tie." Essentially, the device is a wire wrap or wire tie with a release tab.

All of the above embodiments provide a trigger shield that is easy to install and easy to remove by an adult familiar with the structure and operation of the shield. However, removal is virtually impossible for a child. Thus, this life-saving invention represents an important contribution to the art of firearm safety devices.

In all embodiments, a cushioning pad (such as pool table felt, e.g.) may be secured by an adhesive to the inward or leading side of base plate 12 to introduce play into the device to further increase its versatility and to enhance the way it feels when being installed.

This invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A device that preventing access to a trigger, comprising:

a base plate having a preselected size;

a first extension plate movable mounted on said base plate;

locking means for securing said first extension plate of said base plate in a preselected deployment that effectively changes the size of said base plate;

a cover plate having a preselected height and width a first extension plate movably mounted on said cover plate;

locking means for securing said first extension plate of said cover plate in a preselected deployment that effectively changes the size of said cover plate;

said base plate and said cover plate positioned on opposite sides of a trigger guard;

interconnecting means for interconnecting said base plate and said cover plate in sandwiching relation to said trigger guard;

whereby the effective respective sizes of said base plate and said cover plate are changed by deployment of said first extension members so that said base and cover plates are effective to prevent access to triggers when used on weapons of differing sizes.

2. The device of claim 1, wherein said preselected size of said base plate includes a preselected height and length, wherein said first extension plate of said base plate is effective to extend the height of said base plate, and further comprising a second extension plate movably mounted on said base plate, said second extension plate effective to lengthen said base plate when it is operatively deployed, wherein said preselected size of said cover plate includes a preselected height and length, wherein said first extension plate of said cover plate is effective to extend the height of said cover plate, and further comprising a second extension plate movably mounted on said cover plate, said second extension plate effective to lengthen said cover plate when it is operatively deployed.

3. The device of claim 2, further comprising:

a radially extending slot formed in said base plate;

a first and a second stop member disposed on an underside of said base plate, each of said block members being movably mounted for movement along the radial extent of said radially extending slot;

a first and a second fastening member;

a first fastening member having a tool-engageable head on a top side of said base plate, a shank that extends through said radially-extending slot, and a free end that engages said first stop member so that said first fastening member and said first block are radially displaceable along the extent of said radially extending slot when said first fastening member is not tightened with respect to said first block and so that said first block is locked into a preselected position along the extent of said radially extending slot when said first fastening member is tightened;

said second fastening member having a tool-engageable head on a top side of said base plate, a shank that extends through said radially-extending slot, and a free end that engages said second stop member so that said second fastening member and said second block are radially displaceable along the extent of said radially extending slot when said second fastening member is not tightened with respect to said second block and so that said second block is locked into a preselected position along the extent of said radially extending slot when said second fastening member is tightened;

where said base plate is engageable to trigger guards of differing configurations.

4. The device of claim 3, further comprising;

an elongate, upstanding barbed post mounted to said base plate;

an opening formed in said cover plate for receiving said barbed post;

a boss means formed on said cover plate contiguous to said opening;

a latch member pivotally mounted on said boss; and a bias means for maintaining said latch member into barb engaging relation to said barbed post when said latch member is in respose;

whereby said latch member prevents facile disengagement of said base plate and said cover plate.

* * * * *